US006622876B2

(12) United States Patent
Goldberg

(10) Patent No.: US 6,622,876 B2
(45) Date of Patent: Sep. 23, 2003

(54) WIRE SHELF FOR ADJUSTABLE SHELF SYSTEM

(75) Inventor: Mark Goldberg, Lido Beach, NY (US)

(73) Assignee: Systemax, Inc., Port Washington, NY (US)

( * ) Notice: Subject to any disclaimer, the term of this patent is extended or adjusted under 35 U.S.C. 154(b) by 0 days.

(21) Appl. No.: 10/045,447

(22) Filed: Oct. 25, 2001

(65) Prior Publication Data

US 2003/0080080 A1 May 1, 2003

(51) Int. Cl.[7] ..... A47F 5/00

(52) U.S. Cl. ..... 211/181.1; 211/153; 211/187; 108/147.11

(58) Field of Search ..... 211/181.1, 187, 211/182, 153, 106, 90.01, 90.02–90.04; 108/147.11, 147.12–147.17, 106, 107, 144.11; D6/462, 465, 491–494, 481, 509–511, 574, 479, 566

(56) References Cited

U.S. PATENT DOCUMENTS

| | | | | | |
|---|---|---|---|---|---|
| D215,773 | S | * | 10/1969 | Maslow | D6/462 |
| 3,523,508 | A | * | 8/1970 | Maslow | 108/147.13 |
| 3,757,705 | A | * | 9/1973 | Maslow | 108/147.13 |
| 4,064,994 | A | * | 12/1977 | Ondrasik, II | 211/153 |
| 4,595,107 | A | * | 6/1986 | Welsch | 108/147.13 |
| 4,627,543 | A | * | 12/1986 | Nicely | 211/187 |
| 4,629,077 | A | * | 12/1986 | Niblock | 211/187 |
| 4,637,323 | A | * | 1/1987 | Nicely | 108/107 |
| 4,750,626 | A | * | 6/1988 | Nicely | 108/192 |
| D326,579 | S | * | 6/1992 | Leeds | D6/462 |
| 5,390,803 | A | * | 2/1995 | McAllister | 108/147.13 |
| 5,415,302 | A | * | 5/1995 | Carlson et al. | 108/147.13 |
| 5,676,263 | A | * | 10/1997 | Chang | 108/147.13 |
| 5,779,070 | A | * | 7/1998 | Dickinson et al. | 211/181.1 |
| 6,015,052 | A | | 1/2000 | Goldberg et al. | |
| 6,116,436 | A | * | 9/2000 | Ferrucci et al. | 108/181 |

* cited by examiner

*Primary Examiner*—Daniel P. Stodola
*Assistant Examiner*—Jennifer E. Novosad
(74) *Attorney, Agent, or Firm*—Gibbons, Del Deo, Dolan, Griffinger & Vecchione

(57) ABSTRACT

A wire shelf includes at least four post supporting members each disposed at a respective corner of the wire shelf. A pair of end members is disposed at opposing ends of the wire shelf. Each of the end members is comprised of a truss having an upper wire and a lower wire. Each of the end members is joined at one end to one of the post receiving members and is joined at another end to another of the post receiving members. A pair of side members is disposed at opposite sides of the wire shelf. Each of the side members is joined at one end to one of the post receiving members that is joined to one of the end members and is joined at another end to another of the post receiving members that is joined to another of the end members. A plurality of wires is disposed atop and is joined to a top surface of the side members. At least one center support member is disposed between the side members and in parallel therewith. The center support member is comprised of a truss having an upper wire and a lower wire. The upper wire of the center support member is joined to each of the plurality of wires. The upper wire of the center support member is joined at one end to the upper wire of one of the end members and is joined at another end to the upper wire of another of the end members. The lower wire of the center support member is joined at one end to the lower wire of the one of the end members and is joined at another end to the lower wire of the another of the end members.

1 Claim, 4 Drawing Sheets

WIRE SHELF FOR ADJUSTABLE SHELF SYSTEM

BACKGROUND OF THE INVENTION

The present invention is directed to shelving and, more particularly, to wire shelves for adjustable shelf systems.

Adjustable wire shelf systems are known in the art. As an example, U.S. Pat. No. 3,523,508, titled "Adjustable Shelving" and which is incorporated herein by reference, describes an adjustable shelving system in which the wire shelving may be adjusted to various desired heights or assembled and disassembled. The shelves are constructed of criss-crossing wires supported along the periphery by parallel-running, vertically disposed wires joined by a corrugated wire. Welded to the vertically disposed wires, at the corners, are conically shaped post receiving members which taper outwardly toward their lower extremity and receive a respective post and post mounting member. Each post is provided with a plurality of periodically spaced indentations which can accommodate a rib positioned on the inside of the post mounting member so that the post mounting member joins about the post in a holding engagement. The post mounting member also has a conical shape and is adapted to fit snugly within the post receiving members and be engaged within the post receiving member when the post and post mounting member are inserted therein.

The shelves also include a support wire that is similar to the peripherally located, vertically disposed wires but which runs lengthwise across the shelf at the center. The lower part of the center support wire, however, is much shorter in length than the peripherally located, vertically disposed wires and its ends are positioned far from the peripherally located, vertically disposed wires. The short length of the lower part of the center support wire limits the weight that the shelf may support.

Another example, U.S. Pat. No. 4,629,077, titled "Shelf Support System" and which is also incorporated herein by reference, describes an adjustable shelving system that includes a plurality of grooved support posts and individual pieces of shelving. Each shelf includes a support system at each corner that cooperates with the posts to provide positive support under load conditions. The shelves include a center support formed of a pair of parallel wires which extend along the length of the shelf up to, but not in contact with, other pairs of parallel wires located at the front and rear of each shelf. This arrangement of the center support wires similarly restrict the weight that the shelf may support.

It is therefore desirable that a wire shelf is provided in which greater weight may be supported.

SUMMARY OF THE INVENTION

The present invention provides a wire shelf in which the lower wire of the center truss extends at least to the perimeter of the wire shelf and is welded or otherwise joined to the bottom of the shelf perimeter so that greater weight may be supported by the wire shelf.

In accordance with an aspect of the invention, a wire shelf includes at least four post supporting members each disposed at a respective corner of the wire shelf. A pair of end members is disposed at opposing ends of the wire shelf. Each of the end members is comprised of a truss having an upper wire and a lower wire. Each of the end members is joined at one end to one of the post receiving members and is joined at another end to another of the post receiving members. A pair of side members is disposed at opposite sides of the wire shelf. Each of the side members is joined at one end to one of the post receiving members that is joined to one of the end members and is joined at another end to another of the post receiving members that is joined to another of the end members. A plurality of wires is disposed atop, and is joined to, a top surface of the side members. At least one center support member is disposed between the side members in parallel therewith. The center support member is comprised of a truss having an upper wire and a lower wire. The upper wire of the center support member is joined to each of the plurality of wires. The upper wire of the center support member is joined at one end to the upper wire of one of the end members and is joined at another end to the upper wire of another of the end members. The lower wire of the center support member is joined at one end to the lower wire of the one of the end members and is joined at another end to the lower wire of the another of the end members.

According to another aspect of the invention, a wire shelf includes at least four post supporting members each disposed at a respective corner of the wire shelf. Each of the post supporting members includes a circular ring. A pair of end members is disposed at opposing ends of the wire shelf. Each of the end members is comprised of a truss having an upper wire and a lower wire. The upper wire of each of the end members is joined at one end to one of the post supporting members and is joined at another end to another of the post supporting members. The lower wire of each of the end members is joined at one end to the one of the post supporting members and is joined at another end to the another of the post supporting members. Each of the end members includes a corrugated wire disposed between the upper wire and the lower wire of the end member and is joined to a respective one of the upper wire and the lower wire at a plurality of locations. A pair of side members is disposed at opposite sides of the wire shelf. Each of the side members is comprised of a truss having an upper wire and a lower wire. The upper wire of each of the side members is joined at one end to one of the post receiving members that is joined to one of the end members and is joined at another end to another of the post receiving members that is joined to another of the end members. The lower wire of each of the side members is joined at one end to the one of the post supporting members and is joined at another end to the another of the post supporting members. Each of the side members includes a corrugated wire disposed between the upper wire and the lower wire of the side member and is joined to a respective one of the upper wire and the lower wire at a plurality of locations. A plurality of wires is disposed atop and is joined to each of the upper wires of the side members. At least one center support member is disposed between the side members and in parallel therewith. The center support member is comprised of a truss having an upper wire and a lower wire. The upper wire of the center support member is joined to each of the plurality of wires. The center support member includes a corrugated wire disposed between the upper wire and the lower wire of at least one center support member and is joined to a respective one of the upper wire and the lower wire at a plurality of locations. The upper wire of the center support member is joined at one end to the upper wire of one of the end members and is joined at another end to the upper wire of another of the end members. The lower wire of the center support member is joined at the one end to the lower wire of the one of the end members and is joined at the another end to the lower wire of the another of the end members.

According to a further aspect of the invention, a shelf system includes at least one wire shelf as described above and at least four support posts each inserted into a respective one of the post supporting members of said at least one wire shelf.

Other features and advantages of the present invention will become apparent from the following detailed description of the invention with reference to the accompanying drawings.

BRIEF DESCRIPTION OF THE DRAWINGS

The invention will now be described in greater detail in the following detailed description with reference to the drawings in which.

DETAILED DESCRIPTION OF THE INVENTION

Figure 1:
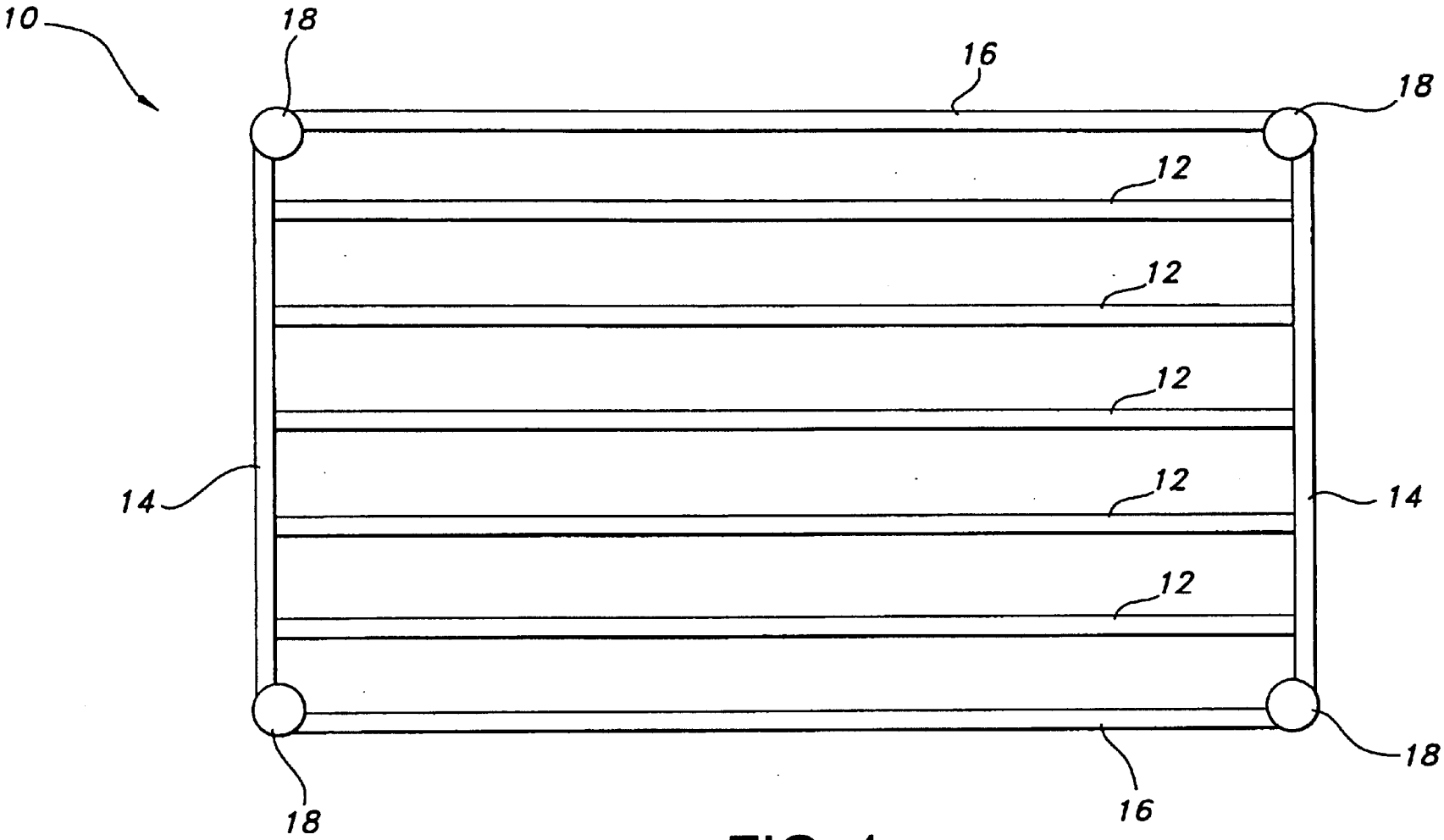
FIG. 1 (PRIOR ART)
FIG. 1 is a top view of a known wire shelf.

FIG. 1 shows a known wire shelf arrangement 10. A plurality of respective support wires 12 extend between a pair of end trusses 14 and provide support for shelf wires (not shown) that are disposed atop the support wires and which extend between a pair of side trusses 16. Located at each corner is a shelf supporting member 18 which is welded to an end of one of the end trusses and to an end of one of the side trusses.

Because the shelf wires are only supported by the support wires 12 and by the side trusses 16, heavy objects that are placed upon the center of the wire shelf may not be supported adequately by the single wire support wires 12 and may cause the shelf wires to sag and, possibly, fail.

Figure 2:
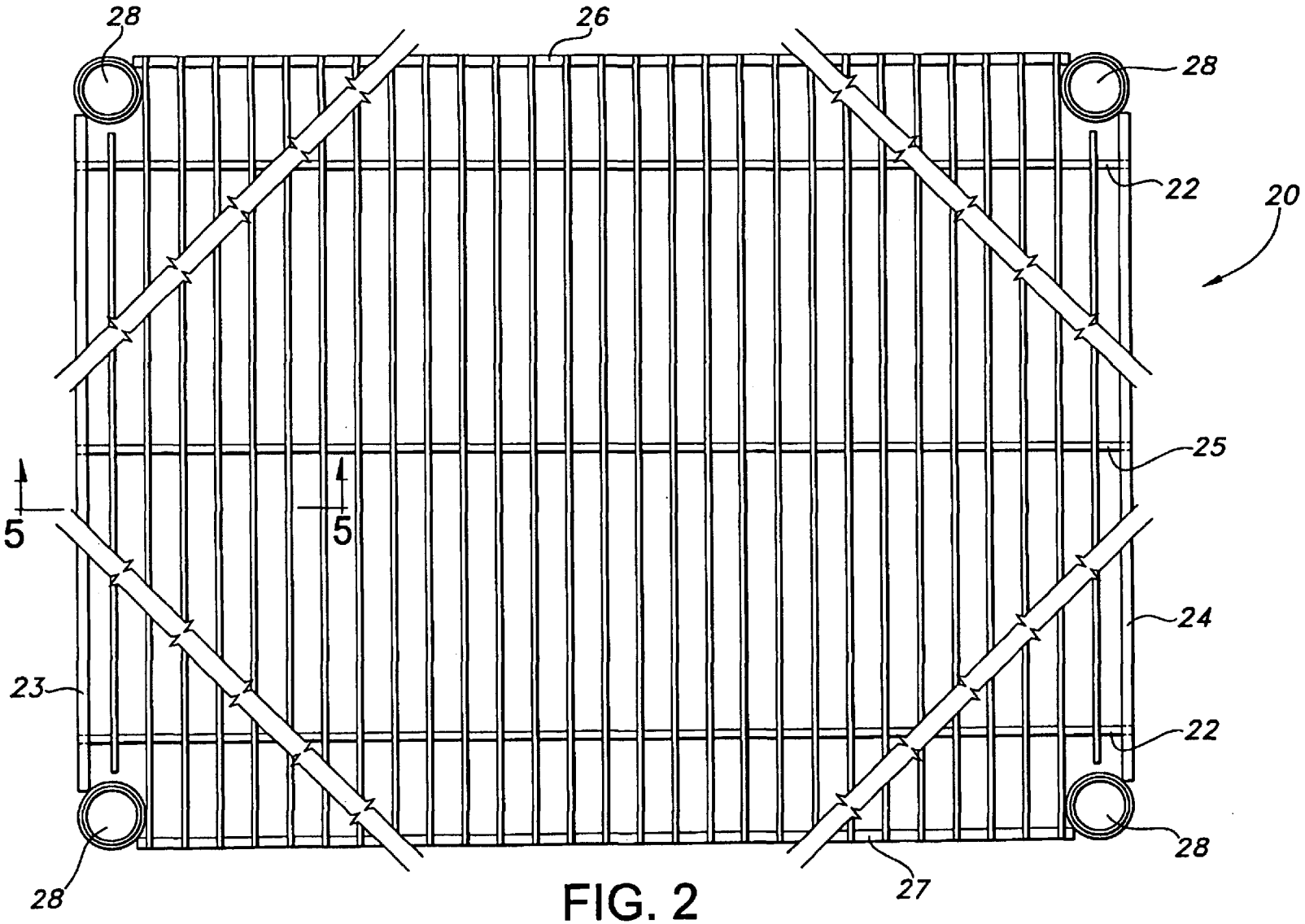
FIG. 2 is a top view of a wire shelf in accordance with an embodiment of the invention.

FIG. 2 illustrates a wire shelf according to the invention in which one or more of the single support wires 12 shown in FIG. 1 are replaced with a center support truss which is joined to the end trusses in accordance with the invention.

The wire shelf 20 is constructed of a plurality of shelf wires 21 which extend from a side truss 26 to a side truss 27. The shelf wires are supported by one or more support wires 22 which extend from one end truss 23 to another end truss 24 and are also supported by one or more center trusses 25. The side trusses 26 and 27 and the end trusses 23 and 24 are each joined at their ends to a respective post support member 28 located at a corner of the shelf.

Figure 3:
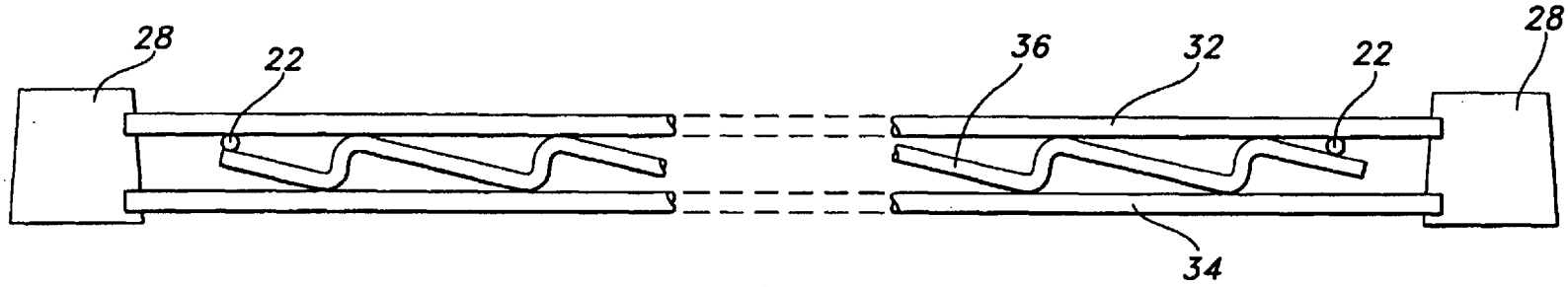
FIG. 3 is an end view of portions of the wire shelf of FIG. 2.

FIG. 3 shows the structure of the end trusses 23 and 24, as well as the post supporting members 28 in greater detail. The end trusses are constructed of a top wire 32, a bottom wire 34, and a corrugated wire 36 that is welded to the top wire 32 and the bottom wire 34 at various locations. The ends of the top wire 32 and bottom wire 34 are welded to the post supporting members 28. The post supporting members 28 are ring shaped, as FIG. 2 shows, but have a conical cross section, as FIG. 3 shows. The support wires 22 are each welded at their ends to the top wire 32 of the end trusses.

Figure 4:
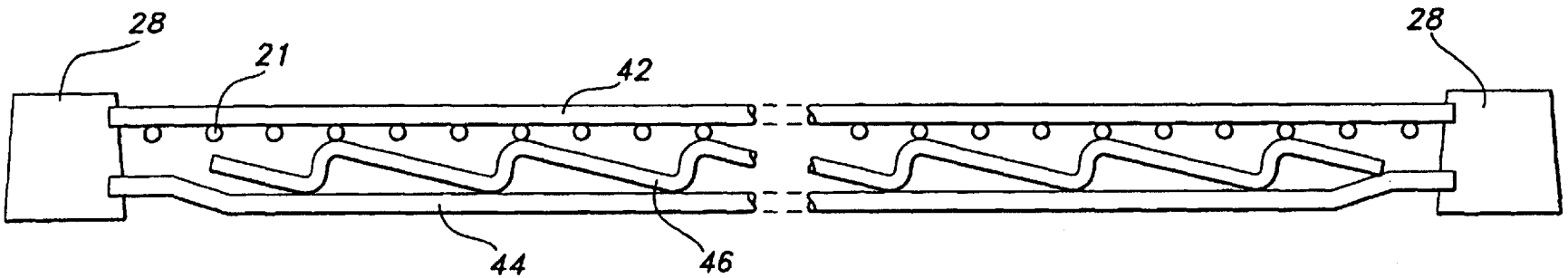
FIG. 4 is a side view of portions of the wire shelf of FIG. 2.

FIG. 4 illustrates the structure of the side trusses 26 and 27 in greater detail. Each side truss is constructed of a top wire 42 and a bottom wire 44. The plurality of shelf wires 21 are each welded to an underside of a top wire 42. A corrugated wire 46 is disposed between the top wire and the bottom wire and is welded at its bends to the bottom wire 44 and to some or all of the shelf wires 21. The ends of the top wire 42 and the bottom wire 44 are welded to the post supporting members 28.

Figure 5:
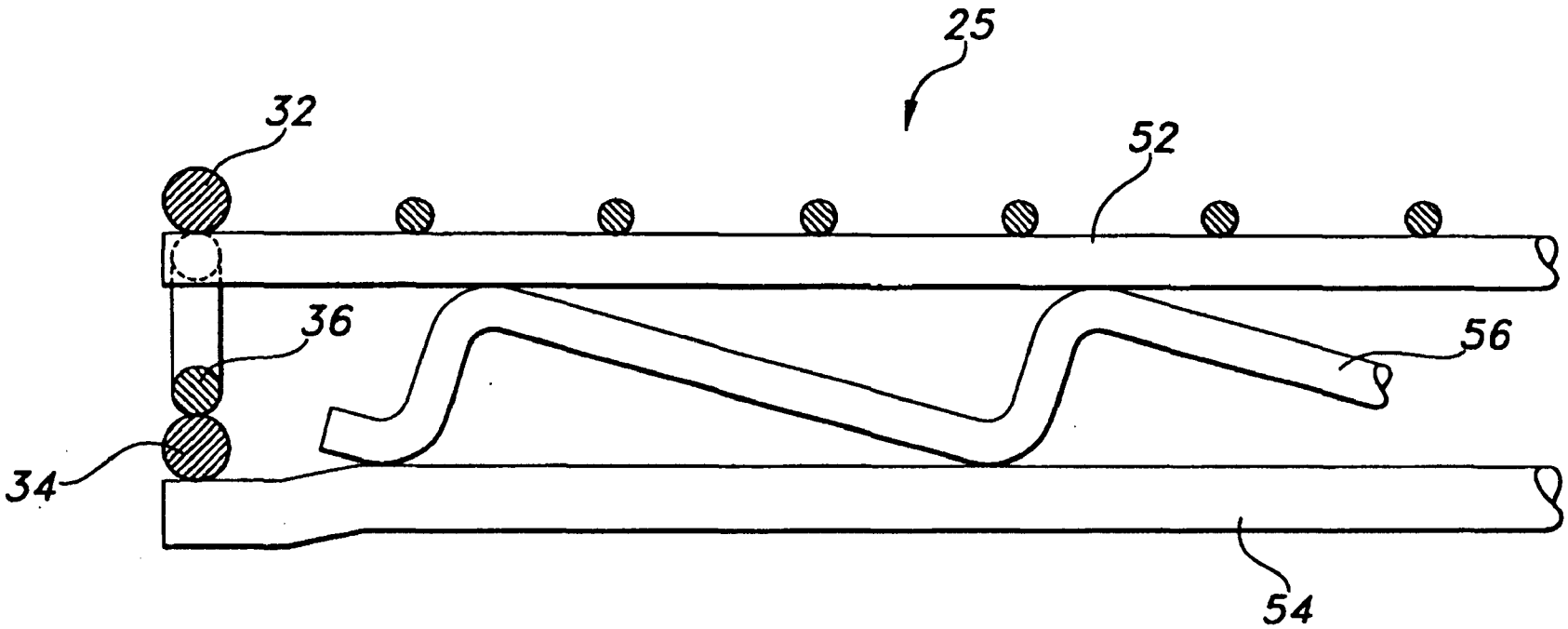
FIG. 5 is a cross-sectional view along line A—A of a portion of the wire shelf of FIG. 2.

FIG. 5 shows a portion of a center support truss 25 in greater detail. The center support truss is constructed of a top wire 52, a bottom wire 54, and a corrugated wire 56 that is welded at its bends to various locations of the underside of the top wire 52 and to various locations of the top side of the bottom wire 54. The center support truss 55 supports a plurality of the shelf wires 21 which are each welded to the topside of the upper wire 52.

In accordance with the invention, the upper wire 52 of the center support truss 25 extends beneath the top wire 32 of each end truss and is welded thereto. Further, the bottom wire 54 of the center support truss includes an extended portion 50 that extends beyond the end of the corrugated wire 56 beneath the bottom wire 34 of each end truss and is welded to the bottom wire 34.

Thus, by extending the center support truss so that its bottom wire extends beneath and is welded to the end trusses, the wire shelf of the invention is capable of supporting greater weight than known shelf systems. By providing more than one center support truss, the wire shelf of the invention may support even greater weight than with a single center support truss.

Although the present invention has been described in relation to particular embodiments thereof, many other variations and modifications and other uses may become apparent to those skilled in the art. It is preferred, therefore, that the present invention be limited not by this specific disclosure herein, but only by the appended claims.

What is claimed is:

1. A wire shelf comprising:

at least four post supporting members disposed at a respective corner of said wire shelf;

a pair of end members disposed at opposing ends of said wire shelf, each of said end members being comprised of a truss having an upper wire and a lower wire, each of said end members being joined at one end to one of said post supporting members and being joined at another end of said post supporting members;

a pair of side members disposed at opposite sides of said wire shelf, each of said side members being joined at one end to one of said post supporting members that is joined to one of said end members and being joined at another end to another of said post supporting members that is joined to another of said end members;

a plurality of shelf wires being disposed spaced apart from each other and being joined to said side members;

at least one center support member truss disposed between said side members and in parallel therewith, said center support member truss having an upper wire and a lower wire, said upper wire of said center support member truss being joined to each of said plurality of shelf wires;

said upper wire of said center support member truss being joined at one end to said upper wire of one of said end members and being joined at another end to said upper wire of another of said end members;

said lower wire of said center support member truss being joined at one end to said lower wire of said one of said end members and being joined at another end to said lower wire of said another of said end members, each of said members being comprised of a side member truss having an upper wire and a lower wire spaced apart from each other, said shelf wires having a topside and an underside, said upper wire of said center support member truss being joined to said underside of said shelf wires, said upper wire of each of said side member trusses being joined to said topside of said shelf wires; and said side member trusses each include a respective corrugated wire, one of said respective corrugated wires being disposed between said upper and said lower wires of one of said side member trusses and joined to said lower wire of the one of said side member trusses at a plurality of locations and directly to the undersides of at least some of the shelf wires, a further one of said respective corrugated wires being disposed between said upper and lower wires of a further one of said side member trusses and joined to said lower wire of the further one of said side member trusses at a plurality of locations and directly to the undersides of at least some of the shelf wires.

* * * * *